US006464414B1

(12) United States Patent
Washnock

(10) Patent No.: US 6,464,414 B1
(45) Date of Patent: Oct. 15, 2002

(54) PRINT MEDIA SENSOR ADJUSTMENT MECHANISM

(75) Inventor: Gregory Paul Washnock, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/532,277

(22) Filed: Mar. 21, 2000

(51) Int. Cl.[7] ..... B41J 11/00; B41J 29/393

(52) U.S. Cl. ..... 400/56; 400/55; 347/19; 250/239

(58) Field of Search ..... 400/703, 56, 55; 73/431; 347/19; 271/265.01, 153, 3.15, 10.02, 10.03; 250/239, 555, 556, 557

(56) References Cited

U.S. PATENT DOCUMENTS

| | | | | |
|---|---|---|---|---|
| 3,861,667 A | | 1/1975 | Jahme | |
| 3,881,817 A | | 5/1975 | Kidd et al. | |
| 3,923,402 A | | 12/1975 | Turcotte | |
| 3,949,979 A | | 4/1976 | Taylor et al. | |
| 3,952,651 A | | 4/1976 | Bolza-Schunemann | |
| 3,957,366 A | | 5/1976 | Taylor et al. | |
| 4,073,585 A | | 2/1978 | Kobayashi et al. | |
| 4,097,041 A | | 6/1978 | Fujimoto | |
| 4,483,528 A | | 11/1984 | Takeyama et al. | |
| 4,540,170 A | * | 9/1985 | Masuda et al. | 271/259 |
| 4,620,807 A | | 11/1986 | Polit | |
| 4,823,195 A | * | 4/1989 | Ito | 358/494 |
| 4,835,573 A | | 5/1989 | Rohrer et al. | |
| 4,919,410 A | | 4/1990 | Robinson et al. | |
| 4,928,951 A | | 5/1990 | Fukui | |
| 4,954,846 A | | 9/1990 | Matsuo et al. | |
| 4,984,778 A | | 1/1991 | Alexander et al. | |
| 5,011,128 A | | 4/1991 | Tsuji | |
| 5,029,845 A | | 7/1991 | Simpson-Davis | |
| 5,030,968 A | | 7/1991 | Benson et al. | |
| 5,104,112 A | | 4/1992 | Briggs et al. | |
| 5,130,757 A | | 7/1992 | Ito | |
| 5,130,807 A | | 7/1992 | Tanabe et al. | |
| 5,162,853 A | | 11/1992 | Ito et al. | |
| 5,163,666 A | | 11/1992 | Kuo | |
| 5,171,980 A | * | 12/1992 | Marzullo et al. | 250/239 |
| 5,192,141 A | | 3/1993 | Chung et al. | |
| 5,193,918 A | | 3/1993 | Lohrmann et al. | |
| 5,235,381 A | | 8/1993 | Namiki et al. | |
| 5,268,705 A | | 12/1993 | Dreinhoff et al. | |

(List continued on next page.)

FOREIGN PATENT DOCUMENTS

| | | |
|---|---|---|
| GB | 2241228 | 8/1991 |

*Primary Examiner*—Daniel J. Colilla
(74) *Attorney, Agent, or Firm*—Jacqueline M. Despit; David E. LaRose

(57) ABSTRACT

The invention provides a media sensor adjustment device for maintaining a media sensor in a preselected orientation with respect to print media prior to feeding the print media to a printing position within the printer. The adjustment device includes frame members, a media sensor housing attached to the frame members for holding a media sensor adjacent a media web and means for maintaining the sensor housing in a substantially fixed orientation relative to a media surface so as to maintain an optical surface of the media sensor substantially perpendicular to an optical path extending from the surface of the sensor to a plane defined by the media surface. The sensor adjustment device thus provides a highly reliable means for maintaining a media sensor in its critical optical perpendicularity at a predetermined distance so that reliable media identification can be obtained.

26 Claims, 9 Drawing Sheets

U.S. PATENT DOCUMENTS 5,329,338 A 7/1994 Merz et al.
5,362,038 A 11/1994 Giles et al.
5,370,380 A 12/1994 Suzuki et al.
5,381,209 A 1/1995 Binder et al.
5,445,371 A 8/1995 Marzullo et al.
5,479,274 A 12/1995 Baba
5,527,026 A 6/1996 Padget et al.
5,547,181 A 8/1996 Underwood
5,557,427 A 9/1996 Kamiya
5,597,157 A 1/1997 Hamilton et al.
5,631,678 A 5/1997 Hadimioglu et al.
5,651,542 A 7/1997 Yamauchi et al.
5,678,127 A 10/1997 Suga
5,709,380 A 1/1998 Petocchi et al.
5,717,976 A 2/1998 Chowdry et al.
5,721,627 A 2/1998 Kamiya
5,751,303 A 5/1998 Erickson et al.
5,751,330 A 5/1998 Autsin et al.
5,751,443 A 5/1998 Borton et al.
5,771,433 A 6/1998 Kimijima
5,842,694 A 12/1998 Brooks et al.
5,848,321 A 12/1998 Roh et al.
5,853,171 A 12/1998 Halpenny
5,900,622 A * 5/1999 Ogura et al. ..... 250/208.1
6,036,298 A 3/2000 Walker
6,068,362 A * 5/2000 Dunand et al. ..... 347/16

* cited by examiner

PRINT MEDIA SENSOR ADJUSTMENT MECHANISM

FIELD OF INVENTION

This invention relates to inkjet printers with automatic sheet feeders which are capable of feeding multiple types of media. More particularly, the invention relates to adjustment mechanisms for optical media sensors for ink jet printers.

BACKGROUND OF THE INVENTION

Ink jet printers are becoming much more common as the printer of choice because of their relatively lower cost compared to laser printers and the ability of ink jet printers to produce multi-color images on a variety of media types at reasonable costs per printed sheet. Recent improvements in ink jet printers include improvements in the print heads and the ink cartridges and improved or specialized ink formulations. These improvements have led to improved print quality which results in the ability to produce high quality and/or photographic images. As the use of ink jet printers continues to expand, the ability to produce images on a variety of print media has also expanded. For many applications, the type of print media used in an ink jet printer has little effect on the usefulness of the resulting printed product. However, for specialized applications such as the production of photographic quality images and the printing of images on film, high quality paper and the like, it is important to identify to the printer the media being utilized. Absorbent media such as paper requires shorter drying times and can generally accept more ink per droplet than polymeric films or less absorbent print media. Upon identification of the media, adjustments such as print speed, sheet feed rate, ink droplet size, and the like may be changed to be more compatible with the media.

Media sensors have been used for detecting the presence and type of media in a printer. Despite such descriptions, there remains a need for a device or apparatus which can reliably maintain a media sensor in a proper orientation with respect to the print media plane regardless of the media thickness, amount or type used in the printer.

SUMMARY OF THE INVENTION

With regard to the foregoing and other objects, the invention provides a media sensor adjustment device for maintaining a media sensor in a preselected orientation with respect to print media prior to feeding the print media to a printing position within the printer. The adjustment device includes frame members, a media sensor housing attached to the frame members for holding a media sensor adjacent to a media surface, and means for maintaining the sensor housing in a substantially fixed orientation relative to a media surface so as to maintain an optical surface of the media sensor substantially perpendicular to an optical path extending from the surface of the sensor to a plane defined by the media surface.

In another aspect, the invention provides an inkjet printer including a printer carriage area containing a carriage, printheads and ink cartridges attached to the carriage and means for moving and activating the printheads for printing on print media. A media support is provided adjacent the printer carriage area for containing a media web, the media web having a media surface defining a media plane. An optical media sensor adjustment device is attached adjacent the media support. The adjustment device includes frame members, a media sensor housing attached to the flame members for holding a media sensor adjacent the media web and for maintaining the sensor housing in a substantially fixed orientation relative to the media surface so as to maintain an optical surface of the media sensor substantially perpendicular to an optical path extending from the surface of the sensor to a plane define by the media surface.

An advantage of the invention is that the sensor adjustment device provides a method and apparatus for reliably maintaining a media sensor in a position relative to a plane defined by the surface of the print media which assures more accurate identification of the media regardless of the media type, thickness or stack height. As described in more detail below, the apparatus of the invention suitably maintains a print media sensor in an orientation which is substantially optically perpendicular to the media surface regardless of the stack height and at a predetermined distance regardless of the media thickness. The terms "substantially optically perpendicular" and "substantially parallel" mean that a plane defined by an operative surface of the sensor is maintained within ± 3.5 degrees of rotation with respect to x and y axes which lie in the plane of the print media.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

Figure 1:
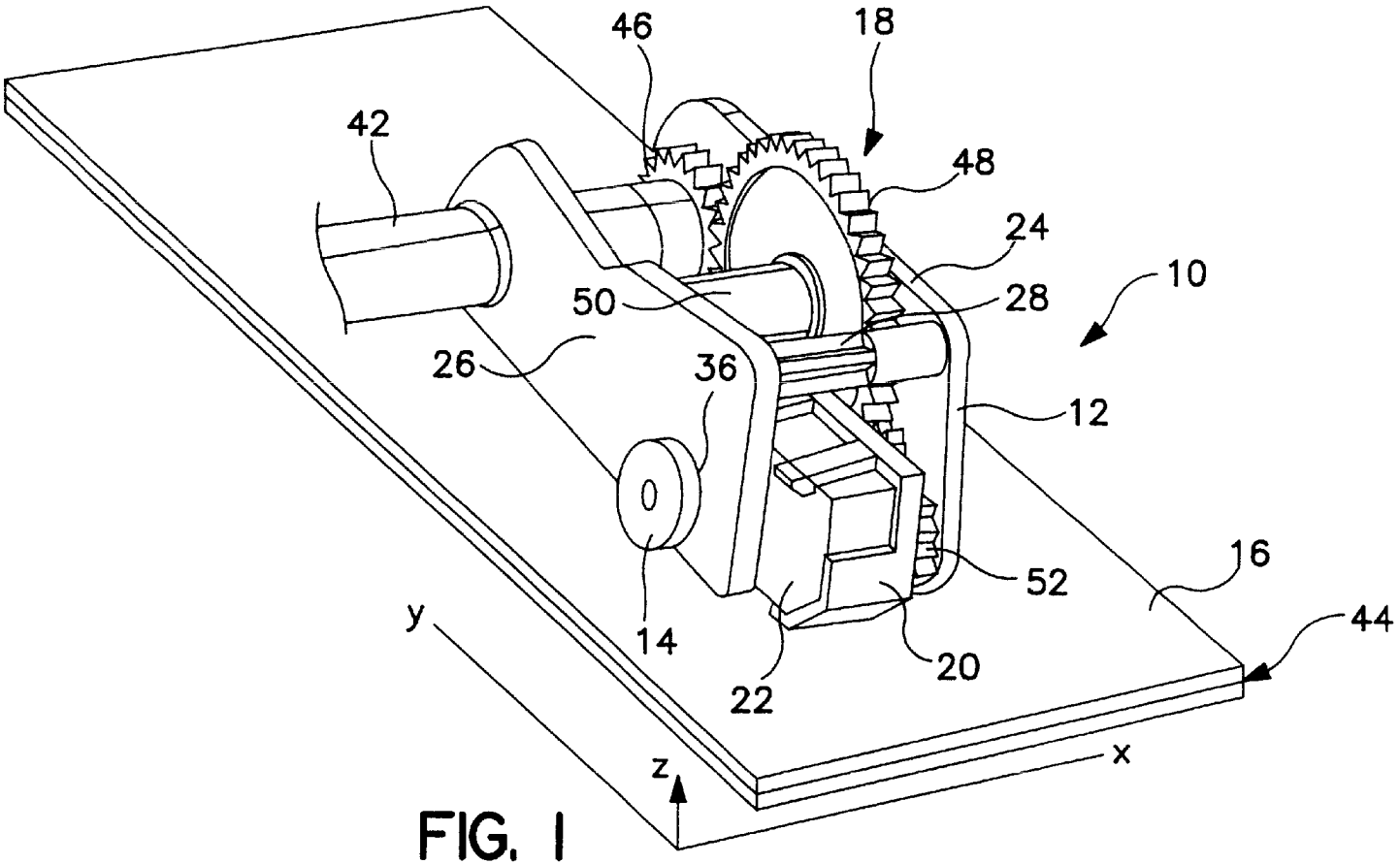
FIG. 1 depicts a perspective view of a media sensor adjustment device according to a first aspect of the invention.
Figure 2:
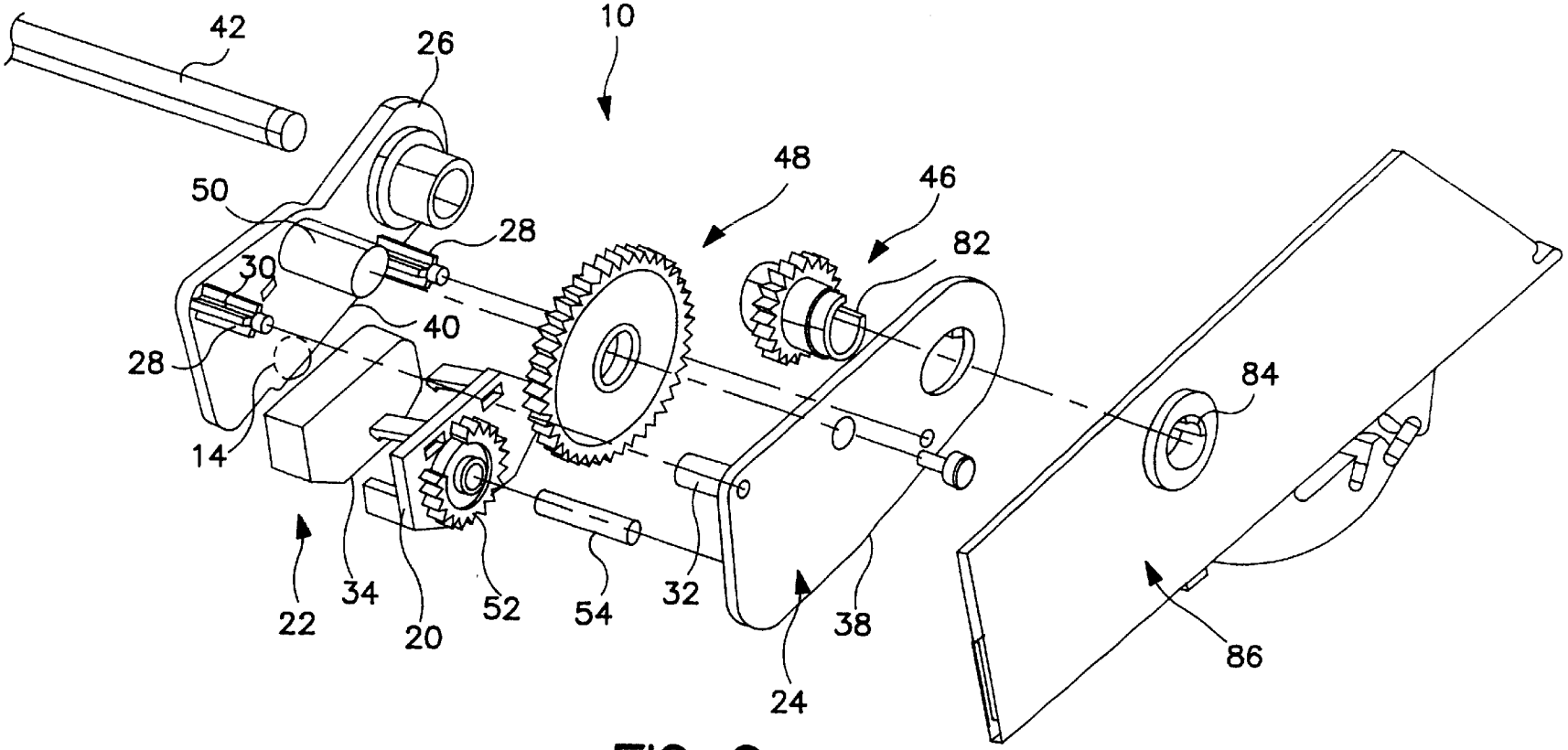
FIG. 2 depicts an exploded view of a media sensor adjustment device according to the first aspect of the invention.

DETAILED DESCRIPTION OF A PREFERRED EMBODIMENT:

With reference to FIGS. 1 and 2, there is shown in perspective view a media sensor adjustment device 10 including frame members 12, means 14 for maintaining a sensor a predetermined distance from a media web surface 16 and device 18 for rotating a sensor housing 20 so that an optical sensor 22 attached to the housing 20 is maintained optically perpendicular to a plane defined by the media surface 16.

The frame members 12 includes a first frame member 24 and a second frame member 26 and joining members 28 for attaching the first and second frame members 24 and 26 to one another in spaced-apart orientation. The first and second frame members 24 and 26 and joining members 28 may be made from a variety of materials including metals, plastics or a combination thereof. The joining members 28 may be bolted, screwed or glued to first and second frame members 24 and 26, or as shown in FIG. 2 may include joinable section 30 attached or molded as part of second frame member 26 and mating section 32 attached or molded as part of first frame member 24. The sections 30 and 32 may be attached to one another as by adhesive, ultrasonic welding and the like.

The optical sensor housing 20 is rotatably disposed between the first and second frame members 24 and 26 so as to maintain an operative surface 34 (FIG. 2) of the sensor 22 substantially parallel to the plane defined by the media surface 16 at preferably a predetermined distance D therefrom. The predetermined distance D preferably ranges from about 1.5 to about 2.5 millimeters. In order to maintain the operative surface 34 of the sensor 22 the predetermined distance D from the media surface 16, a wheel 14 is rotatably attached to frame member 24 or 26 or both so that an edge 36 of the wheel 14 contacts the media surface 16. The wheel 14 may be metal, plastic or rubber coated to provide a preselected spacing between the sensor surface 34 and the media surface 16. Other means may be used to maintain the preselected distance D including resilient leaf springs, fixed projections or the edges 38 or 40 of the first and second frame members 24 and 26 (FIG. 2).

Figure 4:
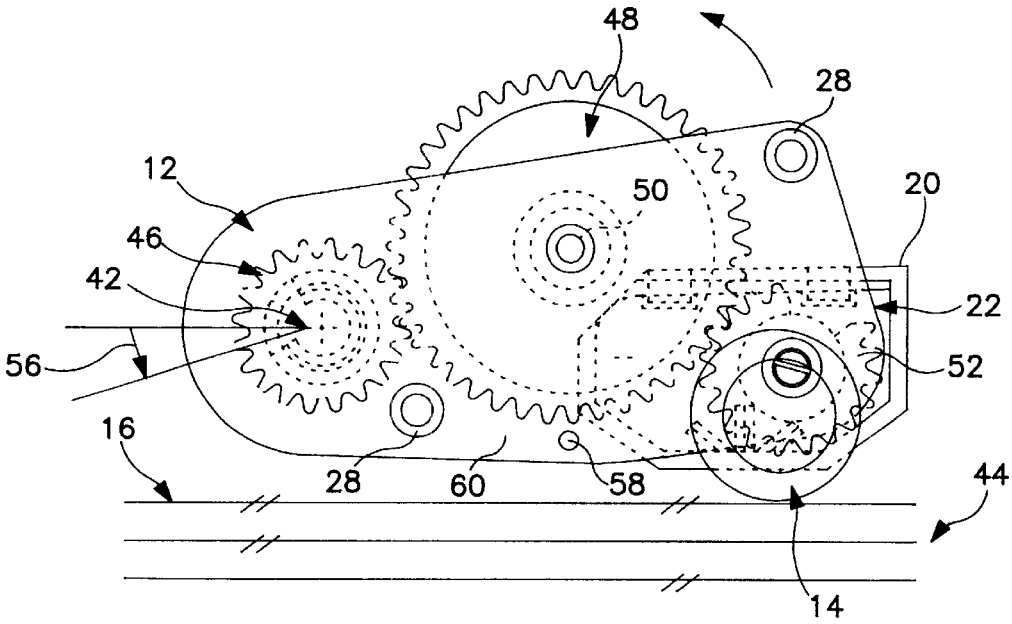

One end of frame members 12 is preferably rotatably attached to a first shaft 42 for rotation about the shaft 42 upon increase or decrease of the height of a media stack 44 or media thickness (FIG. 4). Upon rotation of frame members 12, device 18 causes rotation of the optical sensor housing 20 so that the operative surface 34 of the sensor 22 is maintained substantially parallel with the plane defined by the media surface 16. As seen in FIGS. 1 and 2, one embodiment of device 18 includes three or more intermeshing gears. The gears include a first gear or stationary gear 46 fixedly attached to shaft 42, an idler gear 48 rotatably attached to a second shaft 50, the second shaft 50 being fixedly attached to frame member 24 or 26 and a sensor housing gear 52 fixedly attached to the optical sensor housing 20 for rotating the optical sensor housing relative to a third shaft 54 (FIG. 2). The sensor housing gear 52 and sensor housing 20 may be molded as a unit or may be individually molded and fixedly attached to one another.

Figure 3:
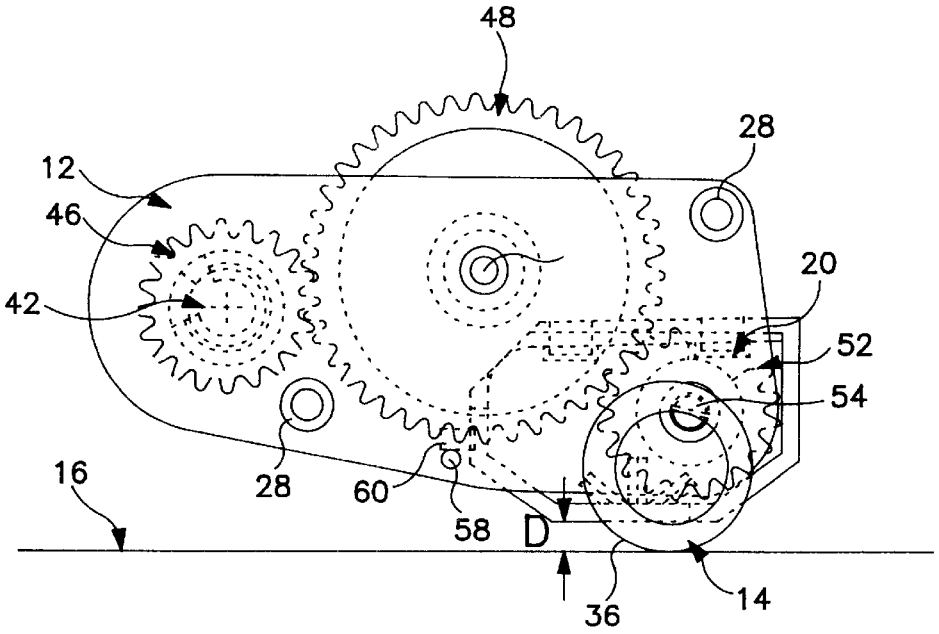
FIGS. 3 and 4 depict elevational side views of structure for maintaining an optical media sensor optically perpendicular to a media surface in accordance with the first aspect of the invention.

As seen in FIG. 4 compared to FIG. 3, an increase in the height of the media stack 44 causes counter-clockwise rotation of frame members 12 about shaft 42 by an amount represented by angle 56. Rotation of the frame members 12 causes the idler gear 48 to also rotate in a counter-clockwise direction. As the idler gear 48 rotates, it meshes with both the stationary gear 46 and the sensor housing gear 52. While the stationary gear 46 preferably remains in a fixed position, the rotation of the idler gear 48 causes the sensor housing gear 52 to rotate correspondingly in a clockwise direction. Since the sensor housing gear 52 is fixedly attached to sensor housing 20, rotation of the sensor housing gear 52 and sensor housing 20 maintains the substantial optical perpendicularity of the optical media sensor 22 attached to the sensor housing 20 and its operative surface 34 relative to the plane parallel with the media web surface 16. The degree of rotation of frame members 12 and sensor housing 20 ranges from about 0 to about 15 degrees about the x-axis with a media stack 44 height of about 10 mm.

As set forth above, a three gear system is provided for rotating the media sensor housing 20 wherein all of the gears are preferably spur gears. However, the invention is not limited to a three gear system as any odd number of spur gears greater than three may be used to accomplish the purposes of the invention. Additional gears may be used to increase or decrease the center to center distance between the stationary gear 46 and the sensor housing gear 52, to reduce the size of the individual gears, or to accommodate other design considerations. The gears are preferably made from plastic materials including polyamides, acetals such as polyoxymethylene and the like. The preferred material for making the gears is polyoxymethylene or acetal.

As described above, the stationary gear 46 is fixedly attached to the first shaft 42 and the sensor housing gear 52 is fixedly attached to the sensor housing 20 which holds an optical sensor 22 so that gear 52 and sensor housing 20 rotate about shaft 54. One or more idler gears 48 are rotatably mounted on one or more shafts 50 adjacent second frame member 26 so as to provide translation of motion between stationary gear 46 and sensor housing gear 52. Each of the one or more idler gears 48 may have an annular opening for passage of a shaft such as shaft 50 therethrough so that the idler gears 48 rotate about their respective shafts. In the alternative, the idler gears 48 may be fixedly mounted to their respective shafts and the shafts rotatably mounted to first and second frame members 24 and 26.

A particularly preferred embodiment comprises a stationary gear 46, a sensor housing gear 52, and one idler gear 48 wherein the idler gear 48 intermeshes with the stationary gear 46 and the sensor housing gear 52 and wherein the gears 46, 48, and 52 are aligned in a plane substantially parallel to frame member 24 or 26. In this embodiment, the stationary gear 46 and the sensor gear 52 preferably have the same module and the same pitch circle diameter. The size of spur gears is generally measured by their pitch circle diameters. The pitch circle of a spur gear connects the teeth around the circumference of the spur gear such that the pitch circles of mating spur gears are tangential. The module of a spur gear is the pitch circle diameter, measured in millimeters, divided by the number of teeth of the gear. In a preferred embodiment, the idler gear 48 also has the same module as the stationary gear 46 and sensor housing gear 52 but the idler gear 48 does not necessarily have the same number of teeth or the same pitch circle diameter. The stationary gear 46 and the sensor housing gear 52 have twenty teeth in a preferred embodiment while the idler gear 48 has forty-two teeth.

In order to prevent excessive counter-clockwise rotation of the sensor housing 20 and/or to aid in the assembly of the sensor housing 20 to frame members 12, a tab stop member 58 and tab 60 are provided. The tab 60 is attached to the sensor housing 20 and extends outward therefrom. When there is no media in the media tray area of the printer, the tab 60 preferably rests on tab stop member 58. The tab stop member 58 may be a rod extending between first and second frame members 24 and 26 or a projection extending from either frame member 24 or 26 toward the opposing frame member such that contact between tab 60 and tab stop 58 are possible.

Figure 5:
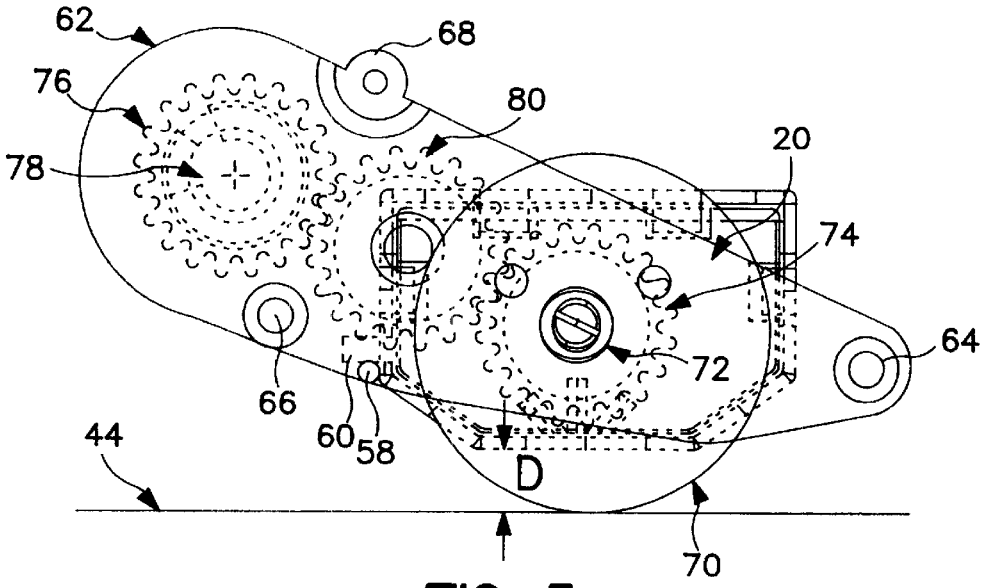
FIGS. 5 and 6 depict elevational side views of an alternate structure for maintaining a media sensor optically perpendicular to a media surface in accordance with the first aspect of the invention.
Figure 6:
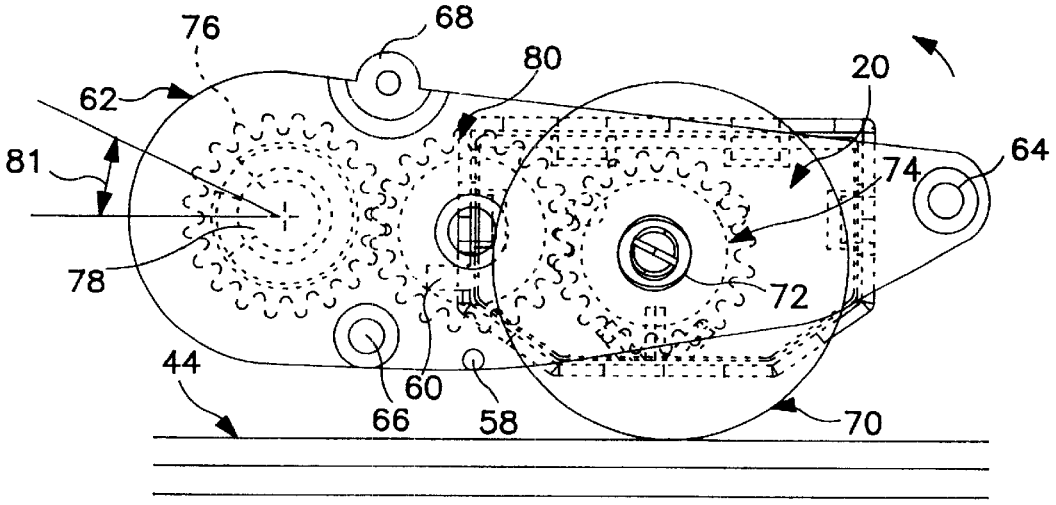

In an alternative embodiment, all three gears have the same number of teeth and the same pitch circle diameter; thus, all three gears would also have the same module as seen in FIGS. 5 and 6. As seen in FIG. 5, frame members 62 are provided for holding the operational components of the optical sensor 22 and rotating means therefor. As before, the frame members 62 include opposing spaced-apart first and second frame members which are attached to one another by means of joining members 64, 66 and 68 as seen generally with reference to FIG. 1. In this embodiment, the means for maintaining predetermined distance D includes wheel 70 which is rotatably mounted on shaft 72. The sensor housing 20 and sensor housing gear 74 are also rotatably mounted on shaft 72 for rotation about a common axis. Stationary gear 76 is fixedly mounted to shaft 78 and idler gear 80 is rotatably mounted between the frame members 62 as generally described above.

Referring now to FIG. 6, as the height of the media stack 44 increases, frame members 62 rotate in a counter-clockwise direction around shaft 78. As the frame members rotate, idler gear 80 is caused by stationary gear 76 to rotate in a counter-clockwise direction which in turn causes sensor housing gear 74 to rotate in a clockwise direction. The amount the sensor housing gear 74 rotates is proportional to an angle 81 between the initial position of gear 80 relative to gear 76 as seen in FIG. 5 with the minimum amount of media in media stack 44 below wheel 70 and the position of gear 80 relative to gear 76 for additional media in media stack 44 below wheel 70 as shown in FIG. 6.

In either the first or second embodiment, the frame members 12 or 62 may be coupled to a pick roll and/or autocompensator assembly for feeding media through the printer.

In such a case, the shaft 42 or 78 may be used to drive the pick roll device. Accordingly, gear 46 or 76 is preferably separate from shaft 42 or 78 so that shaft 42 or 78 rotates relative to gear 46 or 76. In order for gear 46 or 76 to remain stationary as shaft 42 or 78 rotates, gear 46 or 76 is preferably provided with a groove such as groove 82 which mates with a tab 84 on mounting plate 86 of a media feed device for a printer (FIG. 2). The tab 84 fits into groove 82 and prevents gear 46 or 76 from rotating. Pick roll devices for feeding media to a printer are described for example in U.S. Pat. No. 5,527,026 to Padget et al. and U.S. Pat. No. 5,547,181 to Underwood, the disclosures of which are incorporated by reference as if fully set forth herein.

Figure 7:
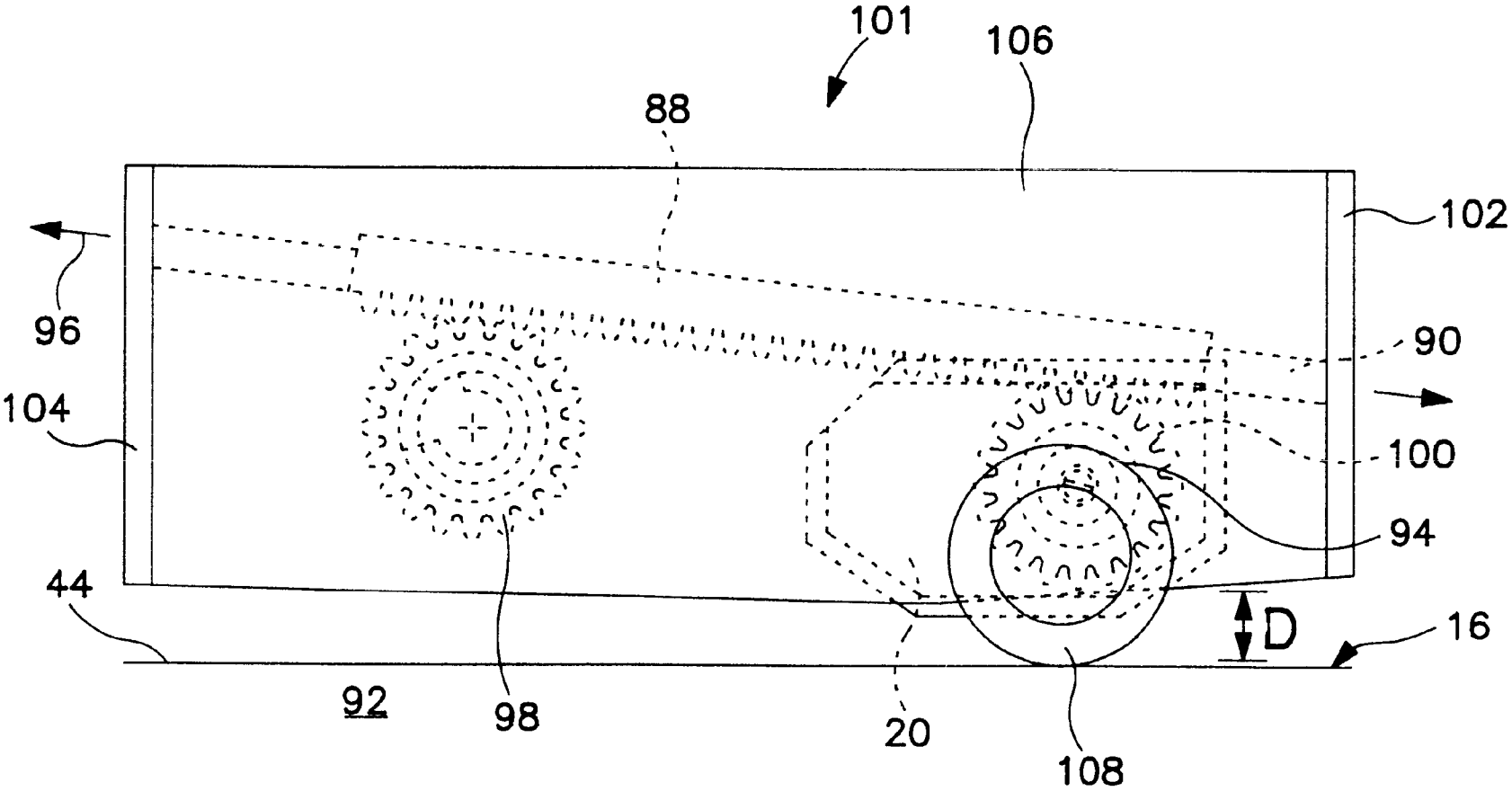
FIG. 7 depicts an elevational side view of yet another alternate structure for maintaining an optical media sensor optically perpendicular to a media surface in accordance with a second aspect of the invention.

In an another alternative embodiment, at least one of the idler gears could be a gear rack such as gear rack 88 (FIG. 7). When used as an idler gear, the gear rack 88 is provided on a slidable elongate member 90 wherein elongate member 90 is at substantially right angles with respect to both first shaft 92 and second shaft 94. The elongate member 90 has a first axis 96 which is coincident with the elongate member 90 and gear rack 88. The first axis of 96 is at substantially right angles with axes along the first and second shafts 92 and 94. The gear rack 88 provides the proper translation of motion between stationary gear 98 and sensor housing gear 100. In this alternative embodiment, the optical media sensor adjustment assembly 101 includes end plates 102 and 104 and side elongate panels 106. The elongate member 90 is slidable mounted to the end plates 102 and 104 for translational movement therebetween along first axis 96. End plates 102 and 104 may be cast as a single piece with side elongate panels 106 or may be formed individually and glued, welded or otherwise fixedly attached to opposing edges of elongate panels 106. As with all of the gears described above, gear rack 88 is preferably made from polyoxymethylene. The slidable elongate member 90 is preferably made of steel and preferably has a diameter of from about 3 to about 4 millimeters. The end plates 102 and 104 are preferably made from the same material as side elongate panels 106 which includes materials such as a synthetic polymeric materials as described above or a metal such as steel, aluminum, and the like.

With continued reference to FIG. 7, the adjustment assembly 101 is caused to rotate in a counter-clockwise direction as the height of the media stack 44 increase by contact between wheel 108 and the web surface 16. Wheel 108 is preferably rotatably mounted to one of the side panels 106 to maintain a predetermined height D of the sensor housing 20 above the media stack 44. As the height of the media stack 44 increase, wheel 108 causes the adjustment assembly 101 to rotate in a counterclockwise direction around shaft 92. As the adjustment assembly 101 rotates, gear rack 88 is caused to slide along its axis 96 between end plates 102 and 104 thereby causing clockwise rotation of sensor housing gear 100. Sensor housing gear 100 is caused to rotate an amount sufficient to maintain a media sensor substantially optically perpendicular to a plane defined by the media web surface 16.

Figure 8:
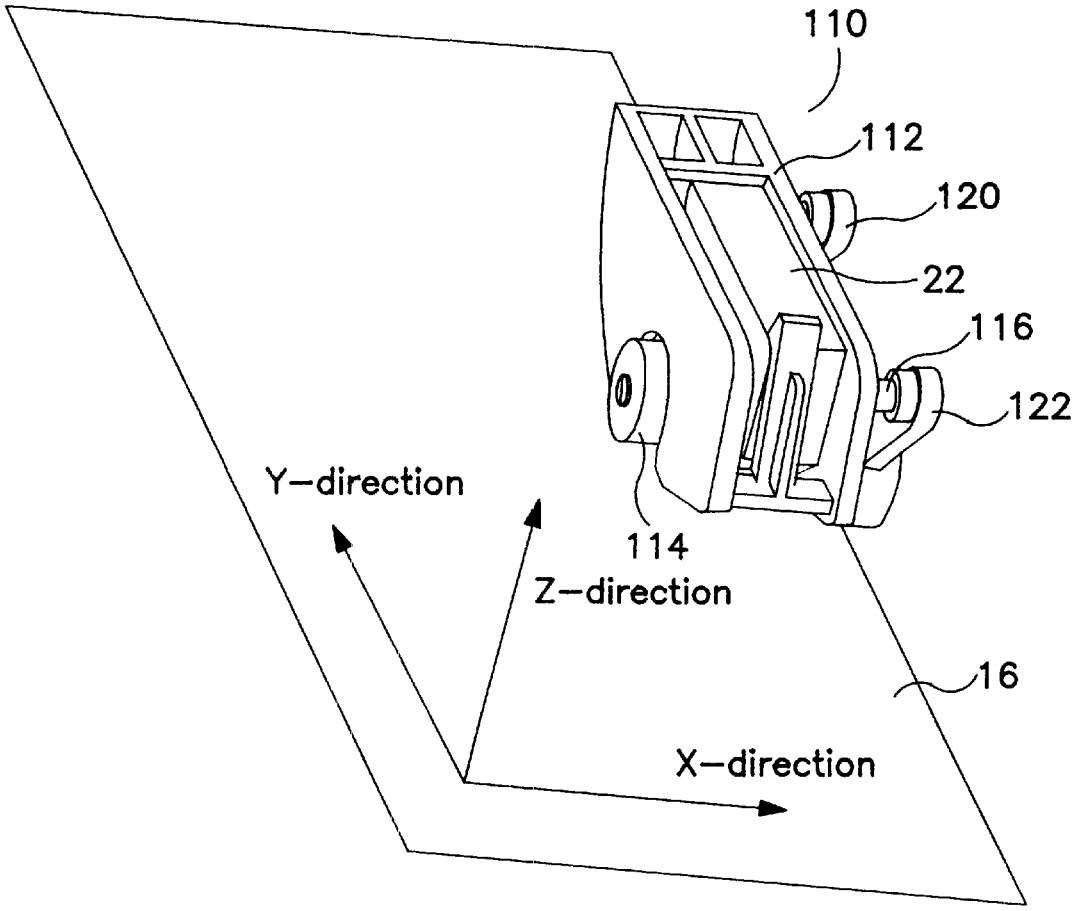
FIG. 8 is a perspective view of another alternative media sensor adjustment device according to a third aspect of the invention.
Figure 9:
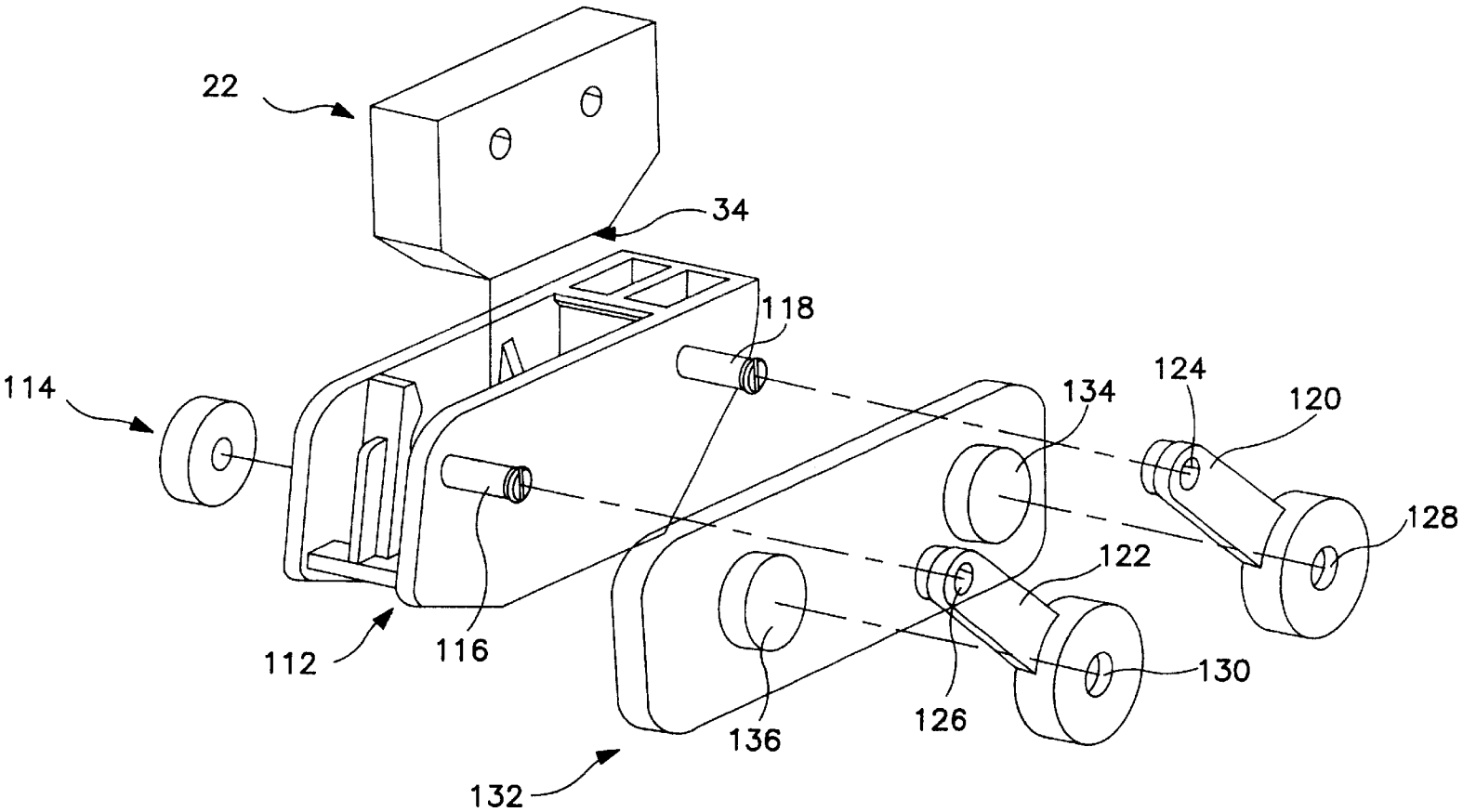
FIG. 9 is an exploded view of the media sensor adjustment device according to the third aspect of the invention.

Another alternative embodiment is provided with reference to FIGS. 8–11. In this embodiment, the sensor 22 is maintained so that its operative surface is 34 remains substantially parallel to a plane defined by the media surface 16 by use of a sensor adjustment mechanism 110 containing bar linkages. A perspective view of the mechanism 110 is shown in FIG. 8. The mechanism 110 includes a sensor housing 112 which is configured to fixedly retain a sensor 22 therein.

In order to maintain a predetermined distance D between the operative surface 34 of the sensor 22 and the media web surface 16, a wheel 114 is preferably rotatably attached to housing 112 on at least one side thereof. The opposite side of the housing 112 preferably contains two spaced apart first and second shafts 116 and 118 for rotatably mounting first and second linkage members 120 and 122 thereon. The first and second shafts 116 and 118 together define a plane which is preferably parallel with the operative surface 34 of the sensor 22.

The first and second linkage members 120 and 122 attached to shafts 116 and 118 are elongate arm members having first apertures 124 and 126 in one end thereof for rotatably mounting the linkage members 120 and 122 to first and second shafts 118 and 116 respectively and second apertures 128 and 130 in an opposing end thereof. The distance between first and second apertures 124 and 128 on first linkage member 120 is preferably the same as the distance between the first and second apertures 126 and 130 on second linkage member 122. Apertures 128 and 130 provide for rotatably mounting the linkage members 120 and 122 on a fixed mounting plate 132 which contains first and second mounting shafts 134 and 136. Mounting plate 132 may be part of the web stack bin of a printer or other fixed structure wherein mounting shafts 134 and 136 are maintained in a plane substantially parallel with a plane defined by the web surface 16 and wherein mounting shafts 134 and 136 are spaced apart a distance substantially equal to that of first and second shafts 116 and 118.

Figure 10:
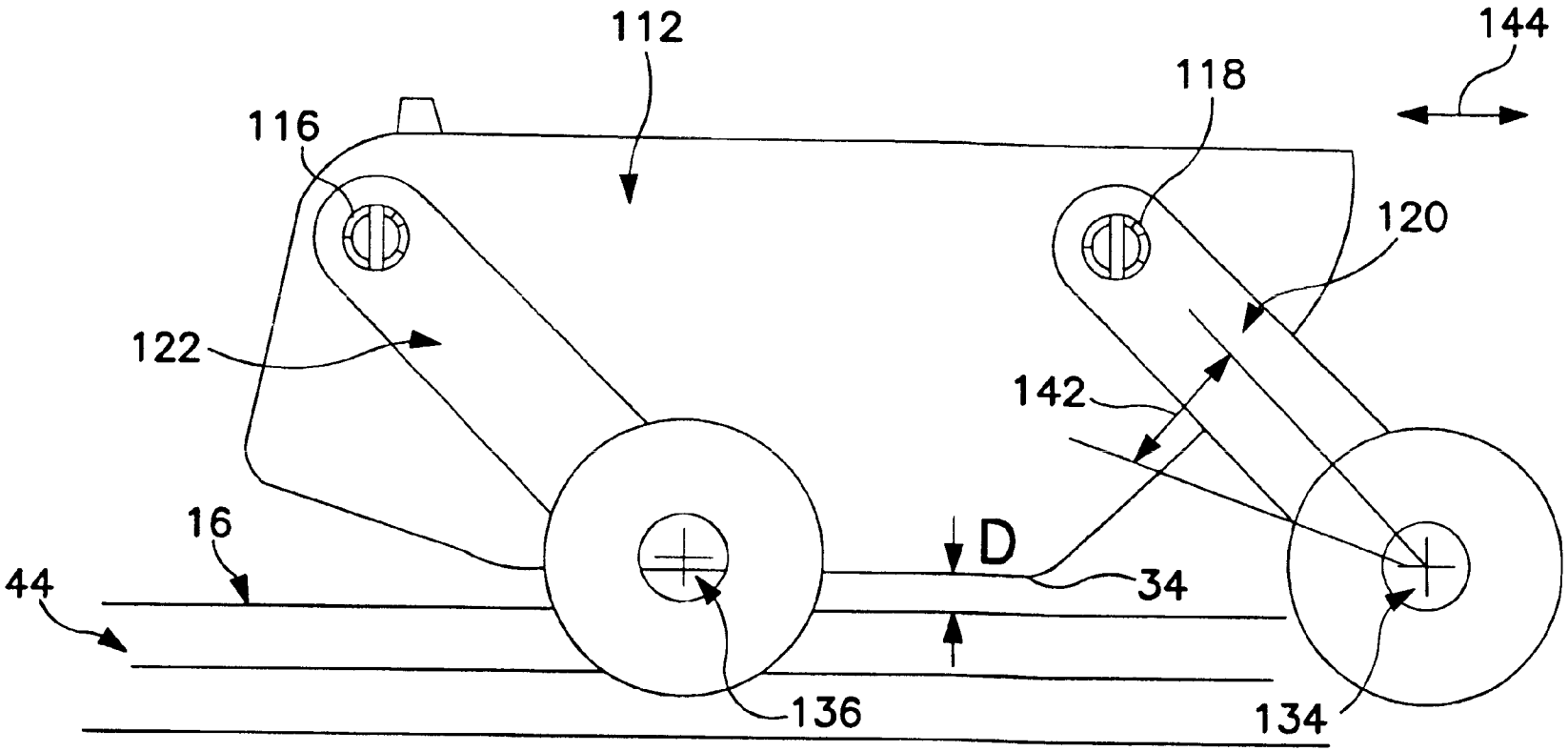
FIGS. 10 and 11 are elevational side views of the media sensor adjustment device according to the third aspect of the invention.
Figure 11:
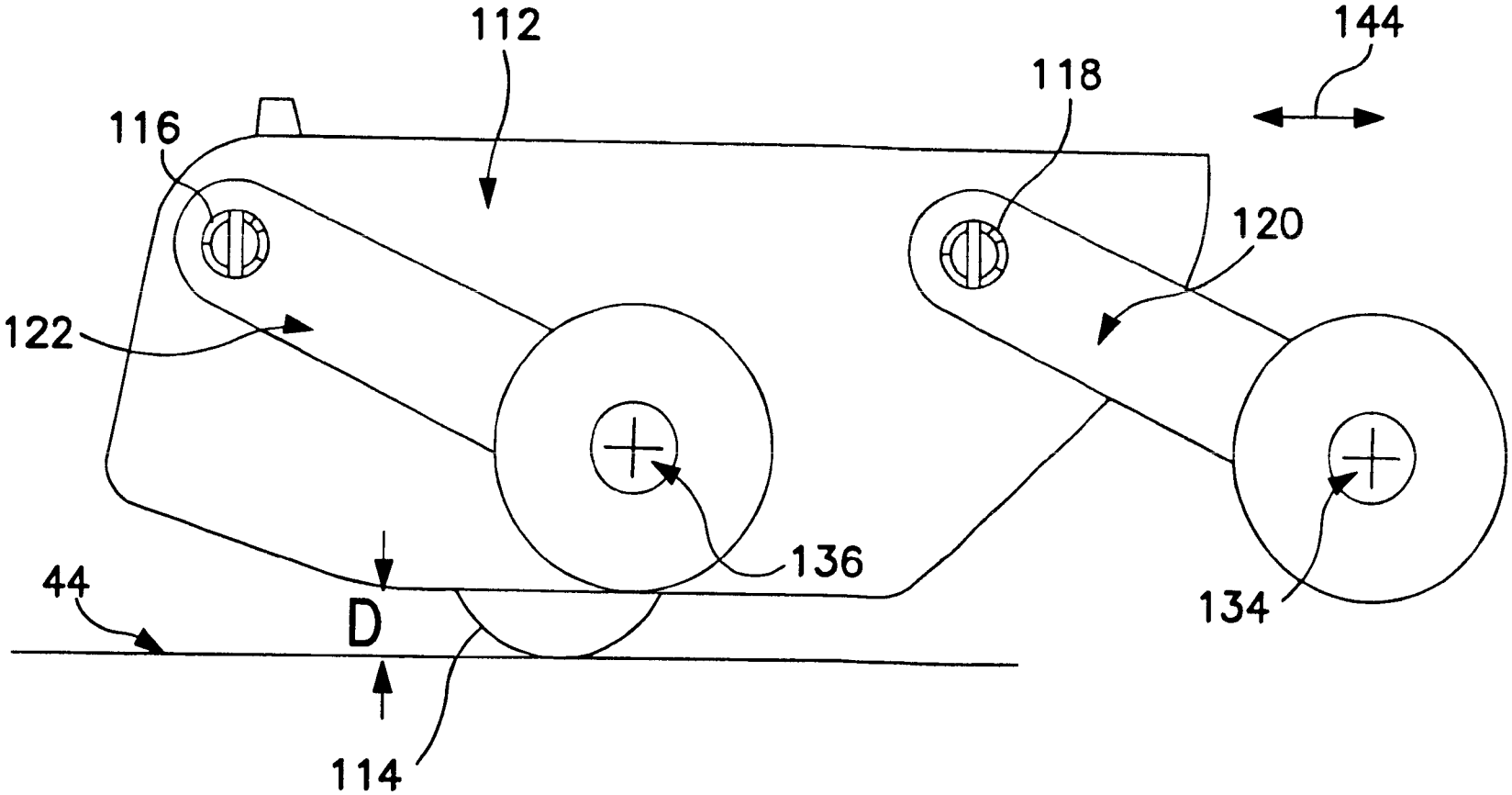

Referring now to FIGS. 10 and 11, as the height of the media stack 44 increases, wheel 114 causes sensor housing 112 to rise in order to maintain the predetermined distance D between the operative surface 34 and the media web surface 16. In a preferred embodiment, the length of the first and second linkage members 120 and 122 is chosen so that the height of the media stack 44 may increase up to about 12 millimeters over an initial height of a media stack 44 as shown in FIG. 11. Because the sensor housing 112 is attached to first and second linkage members 120 and 122 by means of shafts 116 and 118, and the linkage members 120 and 122 are rotatably mounted on fixed mounting shafts 134 and 136, the linkage members 120 and 122 must rotate through an angle 142 thereby causing sensor housing 112 to move forward or backward in the direction of arrow 144. Hence, the only degree of freedom of movement of sensor housing 112 is substantially along a plane parallel with the media web surface 16. Use of two linkage arms 120 and 122, as described, essentially prevents rotation of the sensor housing 112 about an axis parallel with the media web surface.

Typically, an optical media sensor 22 is sensitive to any rotation of its operative surface 34 of an amount greater than plus or minus 3.5 degrees from a plane parallel with the plane defined by web surface 16. With reference to FIGS. 1 and 8, any rotation greater than plus or minus 3.5 degrees about either the x or the y axes would affect the performance of optical media sensor 22. Accordingly, each of the embodiments described above is adapted to substantially prevent rotation of the optical media sensor 22 more than about 3.5 degrees about the x-axis and y-axis. In any of the before mentioned embodiments, rotation of the optical media sensor 22 about the z-axis will not substantially affect the performance of the optical media sensor 22.

It is contemplated, and will be apparent to those skilled in the art from the foregoing specification, drawings, and examples, that modifications and/or changes may be made in the embodiments of the invention. Accordingly it is expressly intended that the foregoing, are only illustrative of the preferred embodiments and modes of operation, not limiting thereto, and that the true spirit and scope of the present invention be determined by reference to the appended claims.

What is claimed is:

1. A media sensor adjustment device for maintaining a media sensor in a preselected orientation with respect to print media prior to feeding the print media to a printing position within a printer, the adjustment device comprising frame members, a media sensor housing attached to the frame members for holding a media sensor adjacent a media web and means for maintaining the sensor housing in a substantially fixed orientation relative to a media surface so as to maintain an optical surface of the media sensor substantially perpendicular to an optical path extending from the surface of the sensor to a plane defined by the media surface, said means for maintaining the sensor housing in a substantially fixed orientation being selected from a gear system containing at least three gears and a linkage system containing at least two substantially parallel and equal length link members rotatably attached on first ends thereof to said frame members in spaced-apart locations which are substantially parallel with a plane defined by the optical surface of the media sensor, the link members having second ends rotatably mounted on a fixed mounting plate.

2. A media sensor adjustment device as in claim 1, wherein said gear system comprises:

a stationary gear fixedly attached to a first shaft, said first shaft being for rotation of said frame members about a first axis defined by said first shaft;

a sensor housing gear rotatably mounted on a second shaft and fixedly attached to said sensor housing for rotational movement of said sensor housing about a second axis defined by said second shaft; and one or more idler gears mounted to said fame members for translation of motion from said stationary gear to said sensor housing gear.

3. A media sensor adjustment device as in claim 2, wherein said means for maintaining the sensor housing in a substantially fixed orientation consists essentially of said stationary gear, said sensor housing gear, and one idler gear, said idler gear intermeshing with said stationary gear and said sensor housing gear.

4. A media sensor adjustment device as in claim 3, wherein said idler gear is substantially the same module as said stationary gear.

5. A media sensor adjustment device as in claim 2, wherein all of said idler gears are substantially the same module as said stationary gear.

6. A media sensor adjustment device as in claim 2, wherein said sensor housing gear is substantially the same pitch circle diameter and substantially the same module as said stationary gear.

7. A media sensor adjustment device as in claim 2, wherein all of said gears are substantially the same pitch circle diameter and substantially the same module.

8. A media sensor adjustment device as in claim 2, wherein said idler gear comprises a gear rack having an axis along said rack which is at substantially right angles with respect to said first and second shafts.

9. A media sensor adjustment device as in claim 1, further comprising means for maintaining the optical surface of the sensor a predetermined distance from said media web.

10. A media sensor adjustment device as claimed in claim 9 wherein said means for maintaining a predetermined distance comprises a wheel rotatably attached to said frame members.

11. A media sensor adjustment device as in claim 1, further comprising an auto-compensation device for advancing media web through a printer wherein said frame members are attached to said auto-compensation device.

12. A media sensor adjustment device as in claim 11, wherein said gear system comprises:

a stationary gear rotatably attached to a first shaft and fixedly attached to the printer, said first shaft being for rotation of said auto-compensation device about a first axis defined by said first shaft;

a sensor housing gear rotatably mounted on a second shaft and fixedly attached to said sensor housing for rotational movement of said sensor housing about a second axis defined by said second shaft; and one or more idler gears mounted to said frame members for translation of motion from said stationary gear to said sensor housing gear.

13. A media sensor adjustment device as in claim 12, wherein said means for maintaining the sensor housing in a substantially fixed orientation consists essentially of said stationary gear, said sensor housing gear, and one idler gear, said idler gear intermeshing with said stationary gear and said sensor housing gear.

14. A media sensor adjustment device as in claim 13, wherein said idler gear is substantially the same module as said stationary gear.

15. A media sensor adjustment device as in claim 12, wherein all of said idler gears are substantially the same module as said stationary gear.

16. A media sensor adjustment device as in claim 12, wherein said sensor housing gear is substantially the same pitch circle diameter and substantially the same module as said stationary gear.

17. An inkjet printer comprising:

a printer carriage area containing a carriage, printheads and ink cartridges attached to the carriage and means for moving and activating the printheads for printing on print media;

a media support adjacent the printer carriage area containing a media web, the media web having a media surface defining a media plane;

an optical media sensor adjustment device attached adjacent the media support, the adjustment device including frame members, a media sensor housing attached to the frame members for holding a media sensor adjacent said media surface and means for maintaining the sensor housing in a substantially fixed orientation relative to the media surface so as to maintain an optical surface of the media sensor substantially perpendicular to an optical path extending from the surface of the sensor to a plane define by the media surface, said means for maintaining the sensor housing in a substantially fixed orientation being selected from a gear system containing at least three gears and a linkage system containing at least two substantially equal length link members rotatably attached on first ends thereof to said frame members in spaced-apart locations which are substantially parallel with a plane defined by said optical surface, the link members having second ends rotatably mounted on a fixed mounting plate attached to said media support.

18. An inkjet printer as in claim 17, further comprising means for maintaining the optical surface of the sensor a predetermined distance from said media surface.

19. An inkjet printer as in claim 17, wherein said means for maintaining a predetermined distance comprises a wheel rotatably attached to said optical media sensor adjustment device.

20. An inkjet printer as in claim 19, wherein said gear system comprises:

a stationary gear fixedly attached to a first shaft, said first shaft being for rotation of said frame members about a first axis defined by said first shaft;

a sensor housing gear rotatably mounted on a second shaft and fixedly attached to said sensor housing for rotational movement of said sensor housing about a second axis defined by said second shaft; and one or more idler gears mounted to said frame members for translation of motion from said stationary gear to said sensor housing gear.

21. An inkjet printer as in claim 20, wherein said gear system consists essentially of a stationary gear, a sensor housing gear, and one idler gear, said idler gear intermeshing with said stationary gear and said sensor housing gear.

22. An inkjet printer as in claim 21, wherein said idler gear is substantially the same module as said stationary gear.

23. An inkjet printer as in claim 20, wherein all of said idler gears are substantially the same module as said stationary gear.

24. An inkjet printer as in claim 20, wherein said sensor housing gear is substantially the same pitch circle diameter and substantially the same module as said stationary gear.

25. An inkjet printer as in claim 20, wherein all of said gears are substantially the same pitch circle diameter and substantially the same module.

26. An inkjet printer as in claim 20, wherein at least one of said idler gears comprises a gear rack having an axis along said rack which is at substantially right angles with respect to said first and second rotational shafts.

* * * * *